US010222042B2

(12) United States Patent
Dull et al.

(10) Patent No.: US 10,222,042 B2
(45) Date of Patent: Mar. 5, 2019

(54) APPARATUS AND METHOD FOR INSTALLATION OF LIGHT FIXTURES

(71) Applicant: GE Lighting Solutions, LLC, East Cleveland, OH (US)

(72) Inventors: Gabor Dull, Budapest (HU); Roland Batai, Budapest (HU); Gabor Balint Toros, Budapest (HU); Istvan Maros, Budapest (HU)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 414 days.

(21) Appl. No.: 14/926,506

(22) Filed: Oct. 29, 2015

(65) Prior Publication Data

US 2017/0122540 A1 May 4, 2017

(51) Int. Cl.

| | |
|---|---|
| ***F21V 23/06*** | (2006.01) |
| ***F21V 21/005*** | (2006.01) |
| ***F21V 23/00*** | (2015.01) |
| ***F21V 23/02*** | (2006.01) |
| ***F21V 23/04*** | (2006.01) |
| ***F21S 2/00*** | (2016.01) |

(Continued)

(52) U.S. Cl.

CPC ..... *F21V 23/06* (2013.01); *F21S 2/005* (2013.01); *F21S 4/20* (2016.01); *F21S 4/28* (2016.01); *F21V 15/015* (2013.01); *F21V 21/005* (2013.01); *F21V 23/008* (2013.01); *F21V 23/023* (2013.01); *F21V 23/0435* (2013.01); *F21V 23/0442* (2013.01); *H01R 25/162* (2013.01)

(58) Field of Classification Search

CPC ..... F21V 23/06; F21V 23/008; F21V 23/023; F21V 23/0435; F21V 23/0442; F21V 21/005

See application file for complete search history.

(56) References Cited

U.S. PATENT DOCUMENTS 8,138,690 B2 3/2012 Chemel et al.
8,616,757 B2 * 12/2013 Leadford ..... F21S 2/005 362/648

(Continued)

FOREIGN PATENT DOCUMENTS

| | | |
|---|---|---|
| DE | 202012005588 U1 | 8/2012 |
| EP | 0089713 A1 | 9/1983 |
| WO | 2013083267 A1 | 6/2013 |

OTHER PUBLICATIONS

Drew Prindle, "Update: Emberlight, The Socket That Turns Any Light into a Smart Light, is Now on Kickstarter", http://www.digitaltrends.com/home/clever-socket-adapter-makes-light-smart-light/#ixzz3U9sWGyUV, pp. 1-8, Jul. 22, 2014.

(Continued)

*Primary Examiner* — Anabel Ton

(74) *Attorney, Agent, or Firm* — Peter T. DiMauro

(57) ABSTRACT

A connection module is configured for installation between a first luminaire and a second luminaire. The module includes a mounting unit. The mounting unit has a left side configured for docking to a right end of the first luminaire and a right side configured for docking to a left end of the second luminaire. The module also includes a device holder that is shaped and sized to hold at least one electronic device. The device holder is removably mounted to the bottom side of the mounting unit.

17 Claims, 9 Drawing Sheets

(51) Int. Cl.

| | |
|---|---|
| ***F21V 15/015*** | (2006.01) |
| ***H01R 25/16*** | (2006.01) |
| ***F21S 4/20*** | (2016.01) |
| ***F21S 4/28*** | (2016.01) |

(56) References Cited

U.S. PATENT DOCUMENTS

| | | | | |
|---|---|---|---|---|
| 2006/0012981 | A1 | 1/2006 | Noh | |
| 2011/0285314 | A1* | 11/2011 | Carney | E04B 9/006 315/294 |
| 2012/0063138 | A1 | 3/2012 | Leadford et al. | |
| 2013/0320861 | A1 | 12/2013 | Sinai et al. | |
| 2014/0218924 | A1* | 8/2014 | Levante | F21V 23/06 362/249.04 |

OTHER PUBLICATIONS

A European Search Report and Opinion issued in connection with corresponding EP Application No. 16196063.8 dated Mar. 28, 2017.

* cited by examiner

APPARATUS AND METHOD FOR INSTALLATION OF LIGHT FIXTURES

BACKGROUND

Technical Field

Embodiments of the invention relate to installation of lighting devices.

Discussion of Art

It has been proposed to incorporate devices such as motion detectors or light sensors into lighting fixtures. However, this tends to increase the complexity of the fixtures and does not facilitate replacement or repair of the additional devices.

It is also frequently the case that sensors or other electronic systems/devices are installed in the vicinity of lighting fixtures, which tends to lead to cluttered, unattractive and inconvenient installations.

The present inventors have now recognized opportunities to incorporate other electrical/electronic devices in installations of lighting devices in a manner which overcomes at least some of the above disadvantages while promoting efficiency and cost-effectiveness.

BRIEF DESCRIPTION

In some embodiments, a connection module is configured for installation between a first luminaire and a second luminaire. The connection module may include a mounting unit. The mounting unit may have a left side configured for docking to the right end of the first luminaire and a right side configured for docking to the left end of the second luminaire. The connection module may also include a device holder that is shaped and sized to hold at least one electronic device. The device holder may be removably mounted to the mounting unit.

DESCRIPTION

Some embodiments relate to an intelligent connection module for installation with suspended luminaires. The connection module may serve as an upgrade or accessory to aid in integrating the luminaires and the installation thereof for industrial internet applications, while facilitating co-installation of additional devices.

In some embodiments, the connection module is formed of two main parts, namely a mounting unit (also referred to as a mounting bracket) and a device holder configured to contain any one or more of a number of different electronic devices for co-installation with luminaires. The mounting bracket may be attachable at both ends to neighboring suspended luminaires. The connection module may serve as a modular unit in an installation of luminaires.

With the connection module bridging between two neighboring luminaires, the aesthetic aspects of the lighting installation (and co-installation of other devices) may be enhanced. Constituent components of the bracket portion of the connection module may provide mechanical connection, and local power supply, and may form a portion of a continuous global power connection for transmission of electric supply between attached luminaires in a continuous deployment. Further constituent components of the bracket portion may contain control and communication units which provide control and communication between one or more devices installed in the device holder portion and a central computer or external systems.

The device holder may be removably mountable in a slot within the mounting unit/bracket. One or more devices of varying types may be contained within the device holder. Examples of such devices include: (a) a motion sensor; (b) a camera; (c) a Bluetooth beacon; (d) a lighting control device; (e) a light sensor; (f) a gas sensor; (g) a temperature sensor; (h) a smoke detector; and (i) a carbon monoxide detector. In some cases, the device or devices contained in the device holder may be related to the operation of one or more of the neighboring luminaires. In some cases, at least one device contained in the device holder performs a different function other than operation of the co-installed luminaires.

With modular installation in conjunction with luminaires, as described herein, the connection modules may facilitate versatile, efficient, cost-effective, aesthetically favorable, and readily replaceable/upgradeable co-installations of various electronic components with lighting installations.

Figure 1:
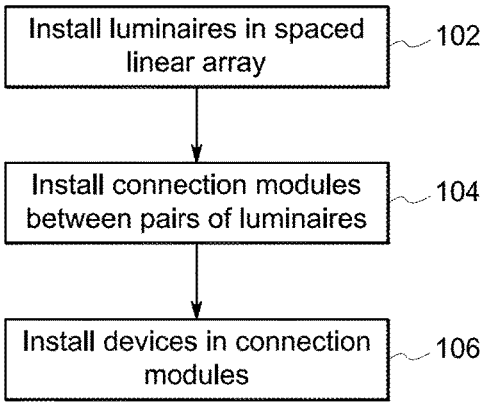
FIG. 1 is a flow chart that illustrates aspects of some embodiments.

FIG. 1 is a flow chart that illustrates aspects of some embodiments.

At 102 in FIG. 1, a series of luminaires are installed in alignment with each other. In at least some cases, there may be a space between neighboring pairs of luminaires.

In some embodiments, the luminaires may be of the kinds commercially available from the General Electric Company (also referred to as "GE") under the designation "IS series". As is known in the relevant industry, luminaires of the type referred to in the previous sentence are configured for connection end to end in continuous installations. Thus, luminaires of this type have docking/connection configurations at their ends (opposite ends of their length dimensions) for engagement with complimentary docking/connection configurations on the adjacent/neighboring/abutting luminaires. Moreover, luminaires of this type have conductive components running the length of the luminaire body and connectable by the end docking configurations so that the continuously installed luminaires are also coupled together electrically/conductively to provide continuous power supply connections along the whole length of the installation.

Figure 2:
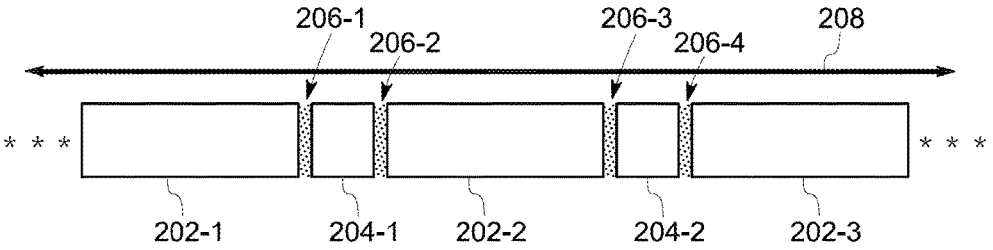
FIG. 2 schematically illustrates an installation of light fixtures according to some embodiments.

At 104 in FIG. 1, connection modules provided according to some embodiments are installed between and bridging neighboring pairs of luminaires. FIG. 2 schematically illustrates an example of such an installation. In FIG. 2, blocks 202-1, 202-2 and 202-3 represented luminaires. The luminaires 202-1, 202-2 and 202-3 may all be identical to each other; as suggested above, the luminaires may be of the commercially available type referred to as the "IS series" and distributed by GE. Blocks 204-1 and 204-2 in FIG. 2 represent connection modules provided according to some embodiments and further described herein. It will be noted that parallel dotted lines are indicated at 206-1, 206-2, 206-3, 206-4 at meeting points between luminaires 202 and connection modules 204. The parallel dotted lines 206 are intended to indicate docking of the luminaire 202 and connection module 204 at the respective meeting point with mechanical connection and electrically conductive connection(s) between the luminaire 202 and the connection module 204 at the meeting point in question. In terms of their geometry, the connection modules may be identical, but—as will be seen—the "payload" of the connection modules (i.e., the electronic device(s) installed therein) may differ.

It will be noted that the luminaires 202 and the connection modules 204 all may be installed along a common axis which coincides with the longitudinal axis of the luminaires 202. Although only three luminaires 202 are explicitly shown in the drawing, in some installations, the number of continuously installed (with interspersed connection modules) luminaires may be greater than three. Installations of less than three aligned luminaires are also contemplated. Alternatively, connection modules may be installed between and bridging luminaires that are not installed along a common axis.

Double-headed arrow mark 208 schematically indicates that there may be a continuous global power connection running longitudinally through all of the luminaires/connection modules. As will be seen, conductive components of the luminaires and connection modules and suitable electrically conductive docking of the luminaires/connection modules may be such as to cause the continuous global power connection to be formed.

Figure 3:
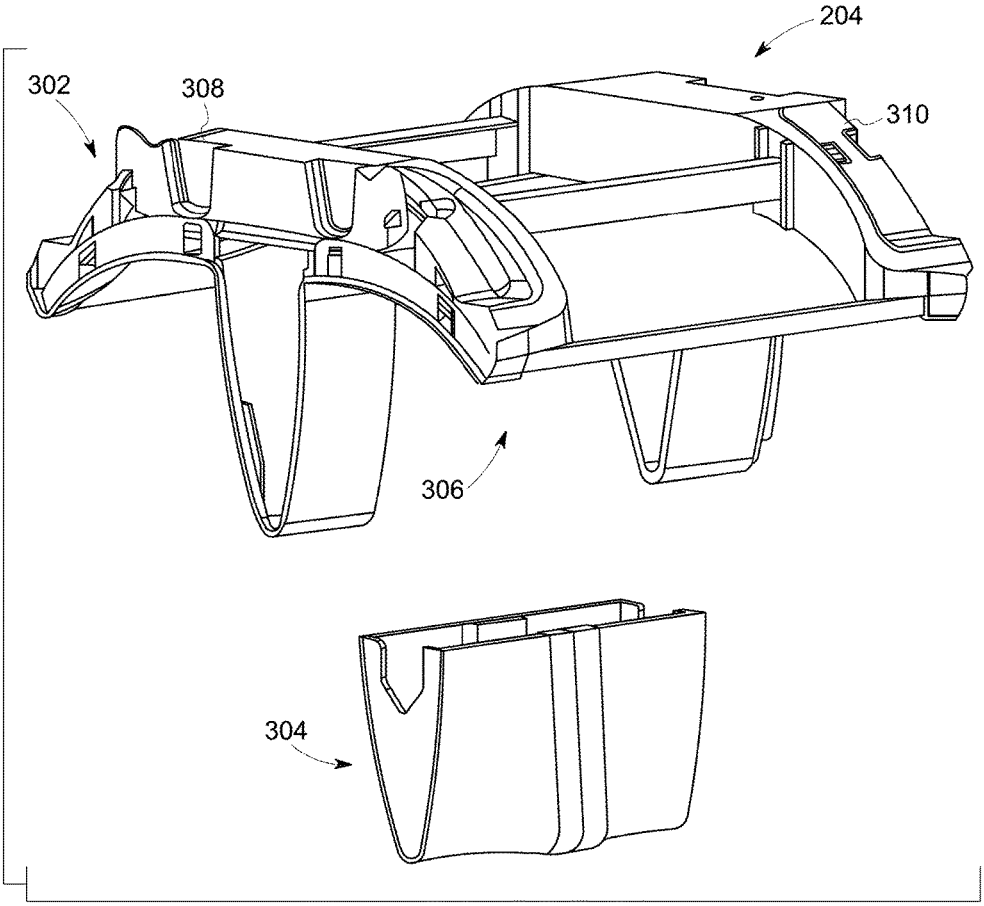
FIG. 3 is an exploded isometric view of a connection module according to some embodiments.

FIG. 3 is an exploded isometric view of a connection module 204 according to some embodiments. Two major components of the connection module 204 are a mounting unit/bracket 302 and a device holder 304. The device holder 304 is shaped and sized to hold one or more electronic devices (not shown) and is removably mountable in a slot 306 formed at an underside of the mounting unit 302. A left side 308 of the mounting bracket 302 is configured to be docked to a right end of a luminaire (not shown in FIG. 3; schematically illustrated in FIG. 2). For example, the left side 308 may have the same configuration as the left end of one of the luminaires discussed above in connection with FIG. 2. A right side 310 of the mounting bracket 302 is configured to be docked to a left end of a luminaire (not shown in FIG. 3; schematically illustrated in FIG. 2). For example, the right side 310 may have the same configuration as the right end of one of the luminaires discussed above in connection with FIG. 2.

Figure 4:
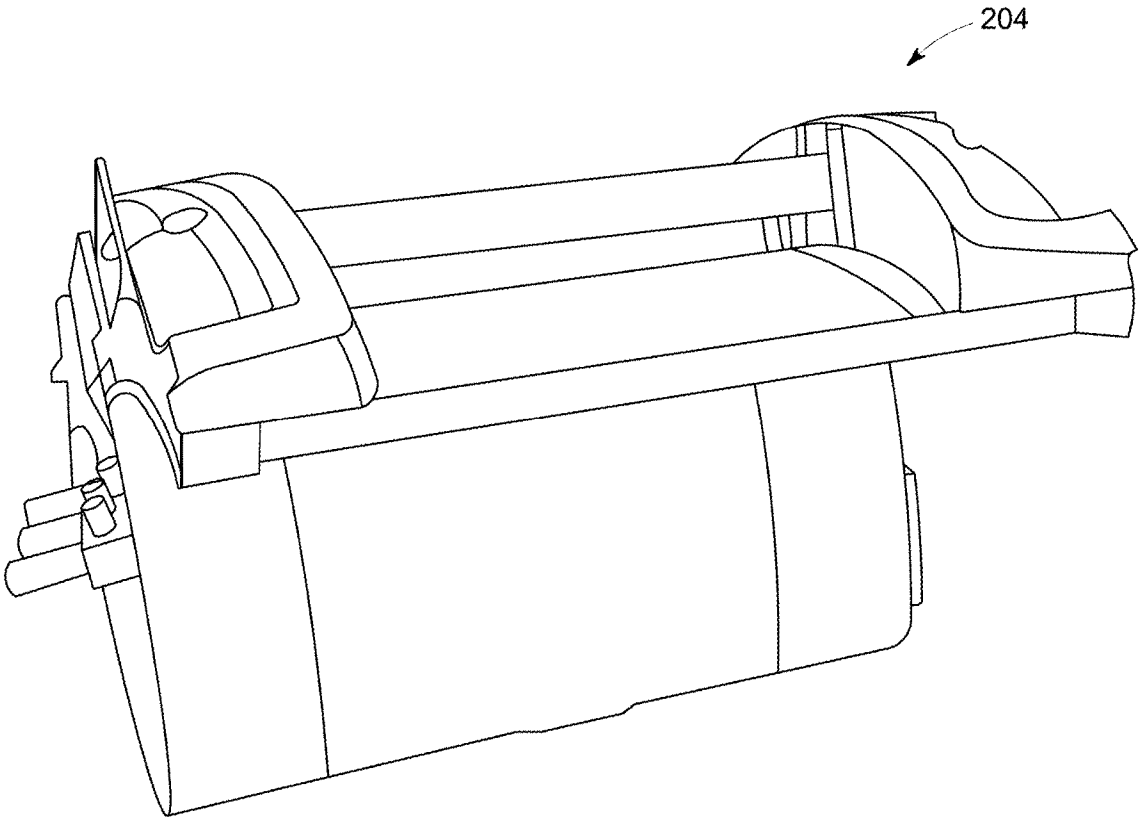
FIG. 4 is an isometric assembled view of the connection module of FIG. 3.
Figure 5:
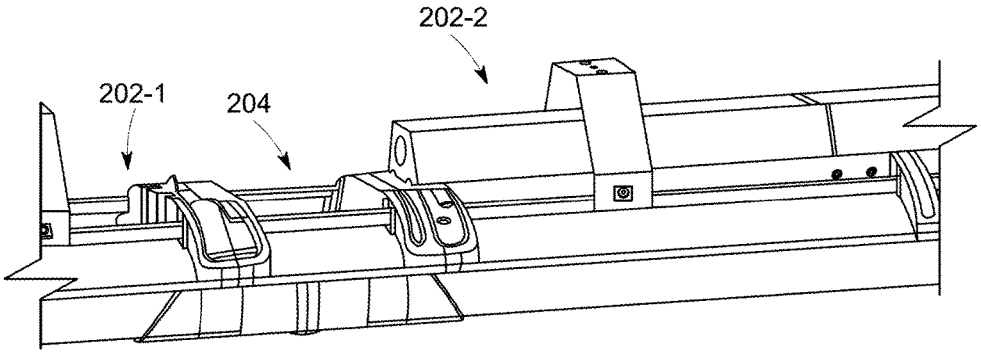
FIG. 5 is an isometric view, taken from somewhat above an installation of the connection module.
Figure 6:
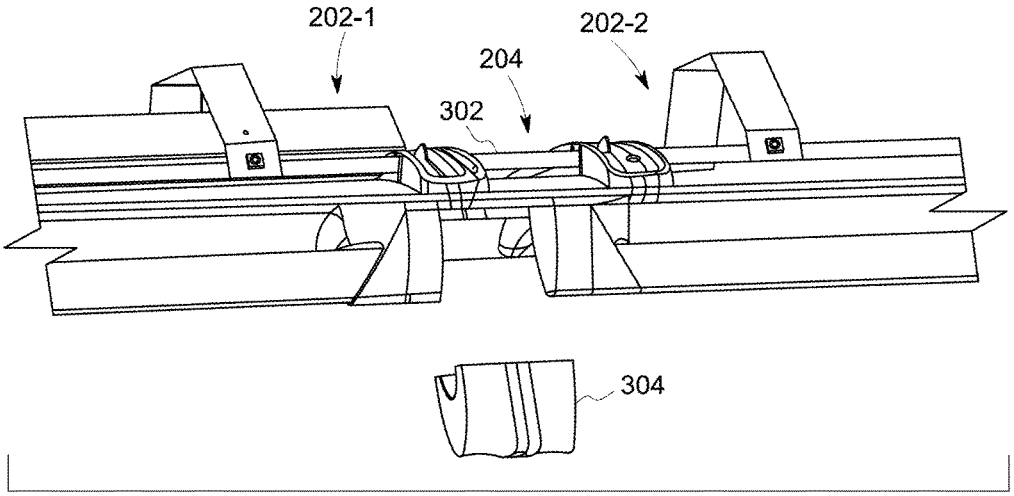
FIG. 6 is an isometric, partially exploded view, taken from somewhat below the installation of the connection module.

FIG. 4 is an isometric assembled view of the connection module 204. FIG. 5 is an isometric view, taken from somewhat above an installation of the connection module 204, installed between luminaires 202-1 and 202-2. FIG. 6 is an isometric, partially exploded view, taken from somewhat below the installation of the connection module 204 between luminaires 202-1 and 202-2. In FIG. 6, device holder 304 is shown dismounted from the mounting unit 302 of the connection module 204

Figure 7:
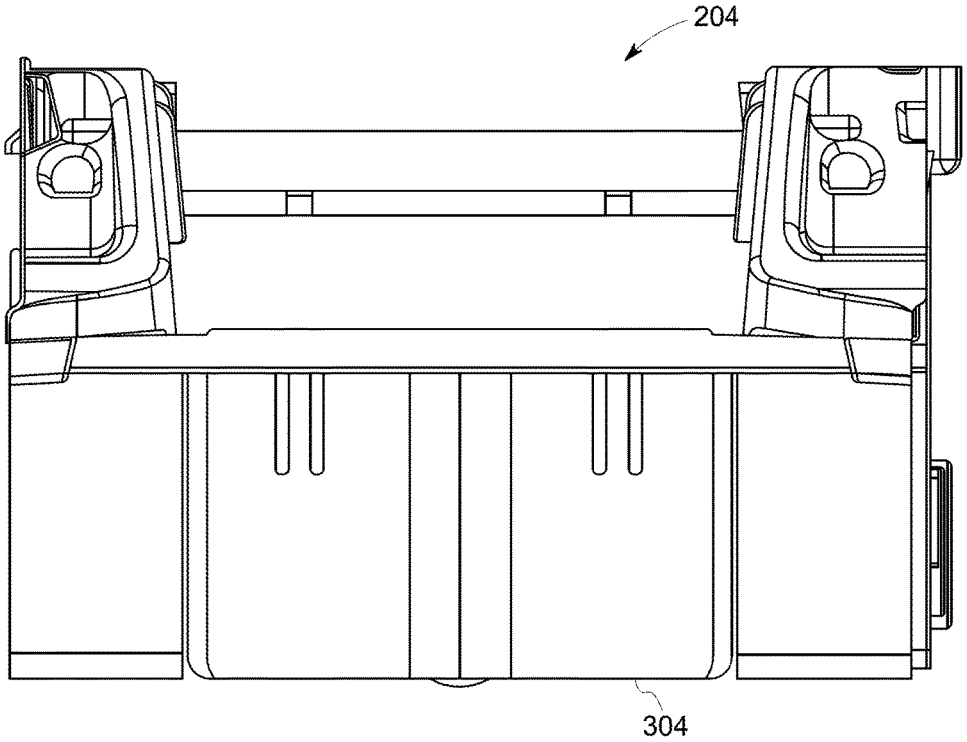
FIG. 7 is a side elevation view of the installation of the connection module.

FIG. 7 is a side elevation view of the installation of the connection module 204 with the device holder 304 seen from the side.

Figure 8:
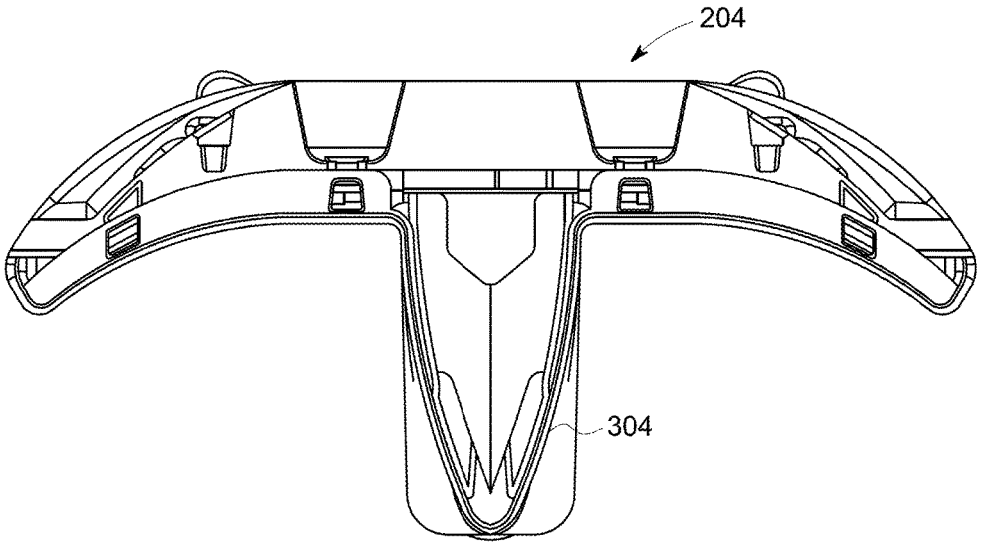
FIG. 8 is a front elevation view of the connection module.

FIG. 8 is a front elevation view of the connection module 204, according to some embodiments. FIG. 8 shows the rounded-V shape of the profile of the device holder 304, in one embodiment.

Figure 9:
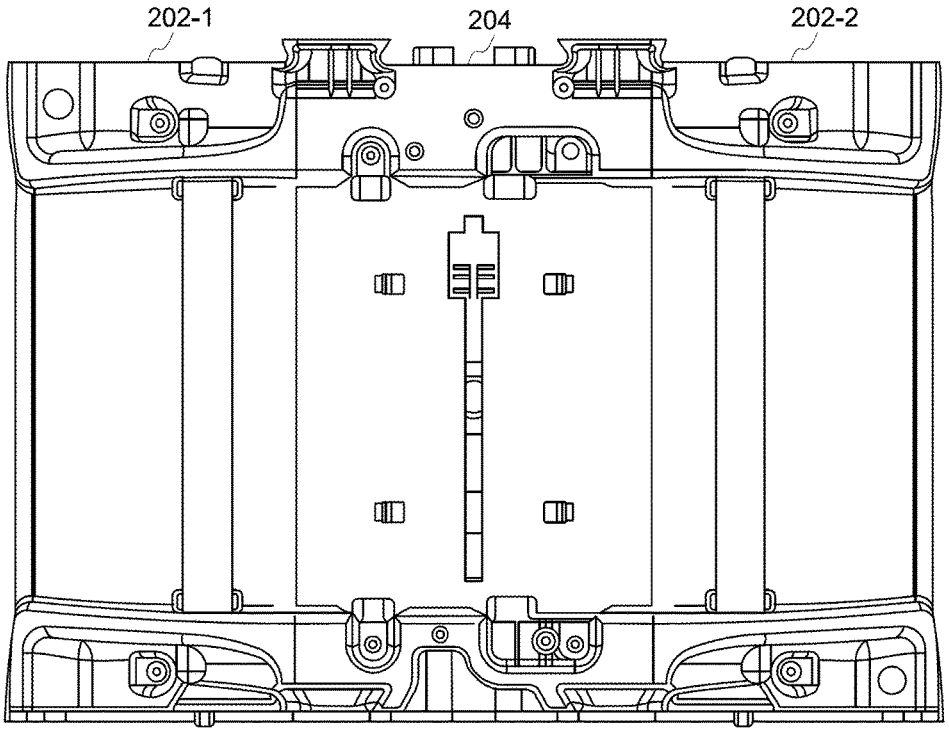
FIG. 9 is a top plan view of the installation of the connection module.

FIG. 9 is a top plan view of the installation of the connection module 204 between luminaires 202-1 and 202-2.

Figure 10:
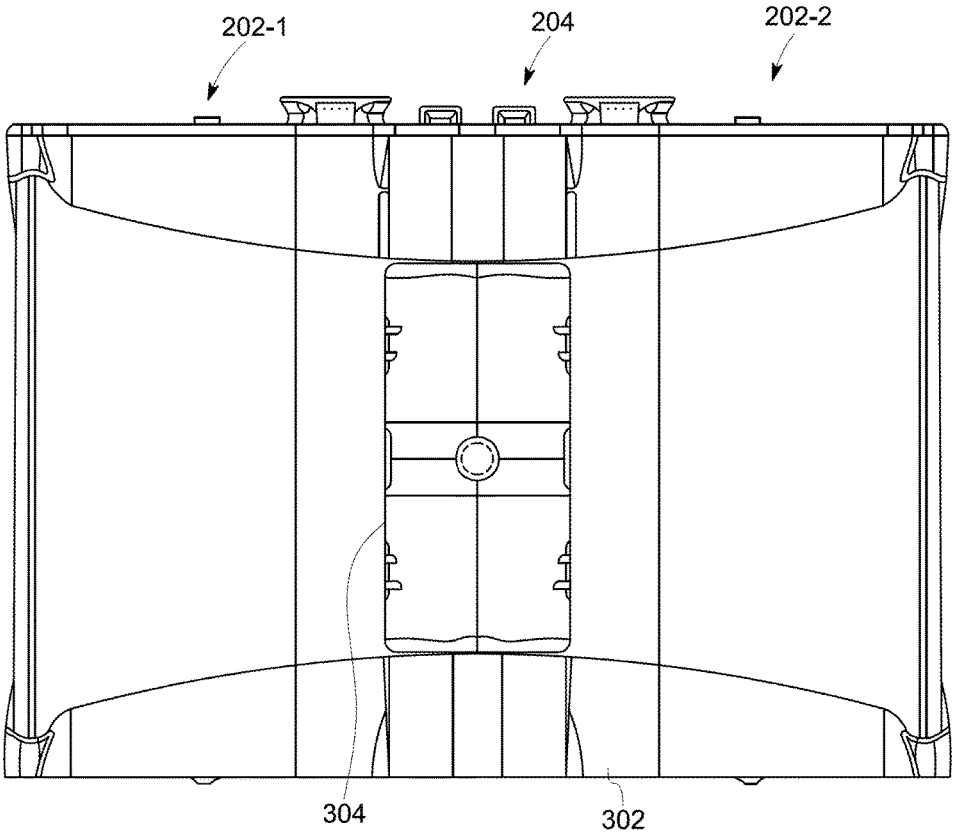
FIG. 10 is a bottom plan view of the installation of the connection module.

FIG. 10 is a bottom plan view of the installation of the connection module 204 between luminaires 202-1 and 202-2. In FIG. 10, the device holder 304 is shown mounted to and suspended from the mounting unit 302 of the connection module 204.

Figure 11:
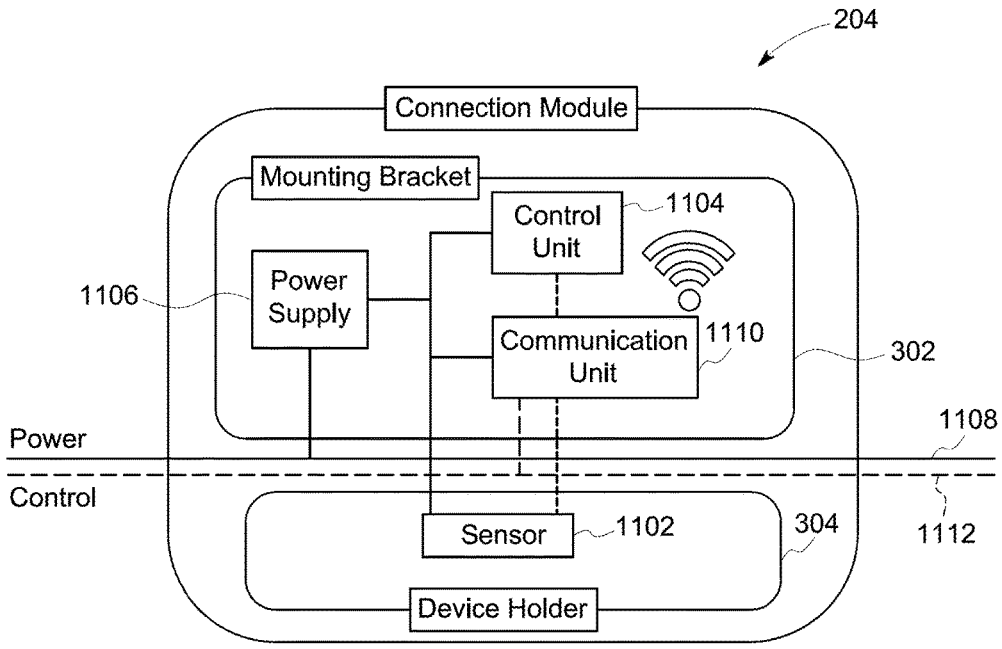
FIG. 11 is a schematic block diagram that illustrates aspects of the connection module.

FIG. 11 is a schematic block diagram that illustrates aspects of the connection module 204, according to some embodiments. FIG. 11 schematically shows connection module 204 in an assembled condition, with device holder 304 removably mounted to the mounting unit 302. An electronic device (in this example embodiments, a sensor 1102) is contained within the device holder 304. In other embodiments one or more other types of electronic devices (not shown), as listed above, may be contained within the device holder 304 in addition to or instead of the sensor.

An electronic control unit 1104 is incorporated in the mounting unit 302. The electronic control unit 1104 is operatively coupled to the sensor 1102. In some embodiments, or depending on the nature of the sensor or other electronic device(s) installed in its stead in other embodiments, the electronic control unit 1103 may provide control signals to the sensor or other electronic device(s) and/or may receive sensor data signals from the sensor or other signals from the electronic device, as the case may be.

A power supply 1106 is incorporated in the mounting unit 302. The power supply is operatively coupled to the sensor 1102 and to the electronic control unit 1104 to supply power to the sensor 1102 and the electronic control unit 1104.

The mounting unit 302 also includes an electrically conductive path component 1108. The electrically conductive path component 1108 forms a portion of the continuous electrical connection 208 referred to above in connection with FIG. 2. The power supply 1106 is operatively coupled to the electrically conductive path component 1108 to receive electricity therefrom.

A communication device 1110 is incorporated in the mounting unit 302 of the connection module 204. The communication device 1110 is operatively coupled to the electronic control unit 1104 and the sensor 1102. The communication device 1110 is operative to provide one- or two-way communication between the sensor 1102 and/or the electronic control unit 1104 and one or more remote and/or system control devices (not shown in FIG. 11). The communication device 1110 is also operatively coupled to the power supply 1106 to receive power therefrom. The communication channel(s) supported by the communication device 1110 may be wireless (e.g., WiFi) or via wireline, or both.

The mounting unit 302 may also include a signal connection path component 1112. The signal connection path component 1112 may form part of a continuous signal path (not shown) that may extend to or through the luminaires (not shown in FIG. 11) to which the connection module 204 is connected.

Figure 12:
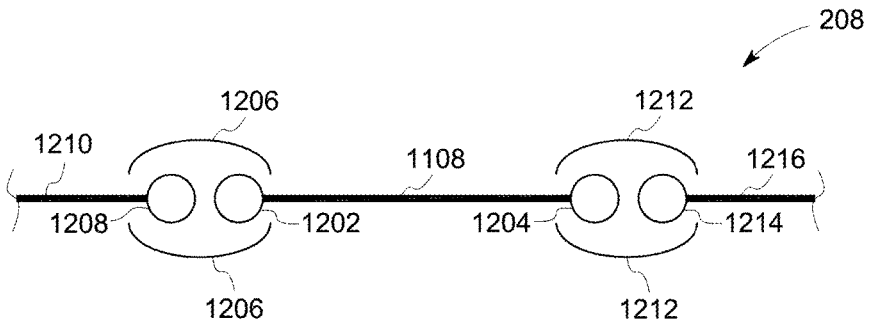
FIG. 12 schematically shows some details of the connection module.

FIG. 12 schematically illustrates aspects of the above-mentioned electrically conductive path component 1108 (FIG. 11) of the connection module 204 and of the continuous electrical connection 208 (FIG. 2). As seen in FIG. 12, the electrically conductive path component 1108 includes a left side conductive contact 1202 and a right side conductive contact 1204. The left side conductive contact 1202 may be located at the left side 308 (FIG. 3, not shown in FIG. 12) of the mounting unit 302, and the right side conductive contact 1204 may be located at the right side 310 (FIG. 3, not shown in FIG. 12) of the mounting unit 302. The electrically conductive path component 1108 may extend from the left side 308 to the right side 310 of the mounting unit 302, to interconnect the luminaires between which the connection module is mounted. As schematically indicated at 1206 in FIG. 12, the left side conductive contact 1202 may be connected to/engaged with a right end conductive contact 1208 of an adjoining luminaire, where the right end conductive contact 1208 terminates an electrically conductive path component 1210 of the latter luminaire. Similarly, and as indicated schematically at 1212, the right side conductive contact 1204 may be connected to/engaged with a left end conductive contact 1214 of the other adjoining luminaire, where the left end conductive contact 1214 terminates an electrically conductive path component 1216 of the latter luminaire.

Figure 13:
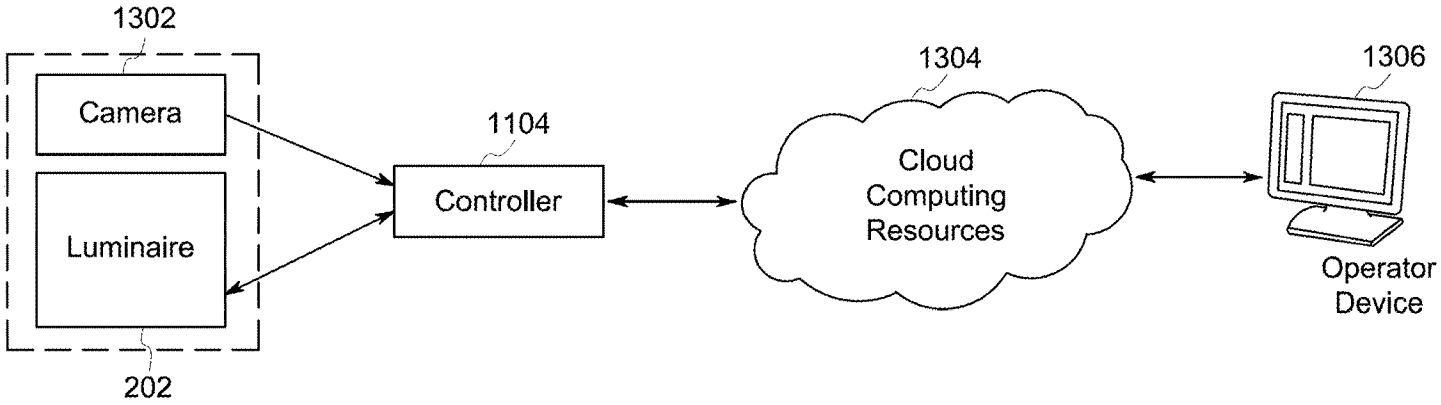
FIG. 13 shows a data management system in which the connection module may play a role.

FIG. 13 shows a data management system 1300 in which the connection module may play a role. FIG. 13 shows the above mentioned control unit 1104 (FIG. 11) operatively coupled to a luminaire 202 and a camera 1302 (in a modular type of installation such as that illustrated in FIGS. 2 and 5-7, with the camera 1302 which may be installed in the device holder of the connection module; the connection module not being represented in FIG. 13 apart from its active components—i.e., in this example, the camera 1302 and the control unit 1104). The control unit 1104 is shown as being in communication with cloud-based computing resources 1304. The types of services available from GE under the brand "Predix" are examples of services that may be provided via the cloud-based computing resources 1304. An operator terminal/device 1306 is shown in communication with the cloud-based computing resources 1304. The operator device 1306 may receive data (i.e., images) from the camera 1302; the operator device 1306 may further receive status signals from the control unit 1104 and/or transmit control/command signals thereto. FIG. 13 shows a data management system in which the connection module may play a role. More generally, and considering cases in which a connection module contains an electronic device or devices in addition to or instead of a camera, signals such as sensor data, status signals and/or other output signals from such electronic device(s) may be communicated to the cloud-based computing resources 1304 and/or to the operator device 1306; and/or command/control signals may be communicated from the cloud-based computing resources 1304 and/or the operator device 1306 to the electronic device(s).

Referring again to FIG. 1, and as will be inferred from other discussion, the process of FIG. 1 may conclude (block 106) with installation of electronic devices in at least some of the device holders of the connection modules.

One type of electronic device that may be installed in a connection module is a camera, such as a surveillance camera. For such a situation, the device holder portion of the connection module may be clear/transparent to permit the camera to obtain images from the area in which the connection module is installed.

Other types of electronic devices that may be installed in a connection module include gas/CO sensors or the like. For such situations, the device holder portion may be at least partially perforated or formed by a screen, so that ambient air is admitted into the device holder.

In one possible application of the modular installation/connection module disclosed herein, cameras may be installed in the connection modules to support a video analytics application for tracking (e.g., pedestrian or vehicular) traffic and the like in a retail store or other facility.

In another possible application of the modular installation/connection module disclosed herein, a control unit for one or more nearby luminaires may be installed in the connection module. For example, characteristics of the light emitted by LED components (not shown) in the luminaires may be controlled.

In still another possible application of the modular installation/connection module disclosed herein, sensors of a type required for "industrial internet" applications may be installed in arrays of connection modules interspersed with luminaires in a lighting installation for a factory floor or other facility.

In yet another application, beacons or other electronic devices suitable for implementing an indoor positioning system may be installed in connection modules interspersed with luminaires.

In yet another application, suitable for a retail store, the electronic devices may be Bluetooth transponders by which advertising or other messaging may be transmitted to shoppers' mobile devices.

In some embodiments, more than one electronic device may be installed in a single connection module, and/or at least some connection modules may have more than one connection slot to accommodate more than one device holder and/or installation of more than one electronic device.

A technical effect is to provide more efficient installations of electronic devices in building and/or lighting fixtures.

Process steps described herein may be performed in any order that is practicable.

Embodiments described herein are solely for the purpose of illustration. A person of ordinary skill in the relevant art may recognize other embodiments may be practiced with modifications and alterations to that described above. All directional references (e.g., proximal, distal, upper, lower, upward, downward, left, right, lateral, front, back, top, bottom, above, below, vertical, horizontal, clockwise, and counterclockwise) are only used for identification purposes to aid the reader's understanding of the presently disclosed technology, and do not create limitations, particularly as to the position, orientation, or use of the presently disclosed technology.

What is claimed is:

1. A lighting installation, comprising:

a series of luminaires, the series of luminaires including at least a first luminaire and a second luminaire, each of the first and second luminaires having a first end and a second end;

a first connection module comprising (a) mounting unit docked to the second end of the first luminaire and the first end of the second luminaire, and (b) device holder shaped and sized to hold at least one electronic device, the device holder removably mounted to a bottom side of the mounting unit;

said first and second luminaires and said first connection module including respective electrically conductive elements interconnected so as to form a continuous electrical power path through the first luminaire, the first connection module, and the second luminaire.

2. The lighting installation of claim 1, wherein the mounting unit includes at least one electrically conductive path component, the electrically conductive path component extending from the left side of the mounting unit to the right side of the mounting unit, the electrically conductive path component configured to provide a continuous electrically conductive path conductively interconnecting the first luminaire with the second luminaire.

3. The lighting installation of claim 2, wherein:

the electrically conductive path component includes (a) a left side conductive contact for conductively contacting an electrical conductor on the second end of the first luminaire and (b) a right side conductive contact for conductively contacting an electrical conductor on the first end of the second luminaire.

4. The lighting installation of claim 1, further comprising an electronic control unit incorporated in the mounting unit, the electronic control unit configured to be operatively coupled to the at least one electronic device to provide control signals to the at least one electronic device.

5. The lighting installation of claim 1, further comprising an electronic control unit incorporated in the mounting unit, the electronic control unit configured to be operatively coupled to at least one of the luminaires to transmit control signals to said at least one of the luminaires.

6. The lighting installation of claim 1, further comprising:

an electronic device mounted within the device holder, the electronic device selected from the group consisting of: (a) a motion sensor; (b) a camera; (c) a Bluetooth beacon; (d) a lighting control device; (e) a light sensor; (f) a gas sensor; (g) a temperature sensor; (h) a smoke detector; and (i) a carbon monoxide detector.

7. The lighting installation of claim 1, further comprising:

an electronic control unit incorporated in the mounting unit and operatively coupled to an electronic device mounted within the device holder; the electronic control unit configured to provide control signals to the electronic device;

a power supply incorporated in the mounting unit and operatively coupled to the electronic device to supply power to the electronic device; and a communication device incorporated in the mounting unit and operatively coupled to the electronic control unit, the communication device configured to provide a communications interface between the electronic control unit and a remote control system.

8. The connection module of claim 1, further comprising:

two or more electronic devices mounted within the device holder, each of the two or more electronic devices selected from the group consisting of: (a) a motion sensor; (b) a camera; (c) a Bluetooth beacon; (d) a lighting control device; (e) a light sensor; (f) a gas sensor; (g) a temperature sensor; (h) a smoke detector; and (i) a carbon monoxide detector.

9. The lighting installation of claim 1, wherein the series of luminaires are not installed on a common axis.

10. The lighting installation of claim 1, further comprising: a first electronic device installed in the device holder.

11. The lighting installation of claim 10, wherein the first electronic device is selected from the group consisting of: (a) a motion sensor; (b) a camera; (c) a Bluetooth beacon; (d) a lighting control device; (e) a light sensor; (f) a gas sensor; (g) a temperature sensor; (h) a smoke detector; and (i) a carbon monoxide detector.

12. The lighting installation of claim 10, further comprising:

a control device incorporated in the first connection module;

a communication device incorporated in the first connection module; and a power supply incorporated in the first connection module.

13. The lighting installation of claim 12, wherein each of the control device, the communication device and the power supply is operatively coupled to the first electronic device.

14. The lighting installation of claim 1, wherein at least one control signal is provided to said first luminaire via said first connection module.

15. The lighting installation of claim 14, wherein at least one control signal is provided to said second luminaire via said first connection module.

16. The lighting installation of claim 1, wherein the device holder is removably mounted to a slot within the mounting unit.

17. A lighting installation, comprising:

a series of luminaires, the series of luminaires including at least a first luminaire and a second luminaire, each of the first and second luminaires having a first end and a second end;

a first connection module comprising (a) mounting unit docked to the second end of the first luminaire and the first end of the second luminaire, and (b) device holder shaped and sized to hold at least one electronic device installed in the device holder, the device holder removably mounted to a slot within the mounting unit;

the electronic device selected from the group consisting of: a motion sensor; a camera; a Bluetooth beacon; a lighting control device; a light sensor; a gas sensor; a temperature sensor; a smoke detector; and a carbon monoxide detector;

said first and second luminaires and said first connection module including respective electrically conductive elements interconnected so as to form a continuous electrical power path through the first luminaire, the first connection module, and the second luminaire;

wherein the series of luminaires are not installed on a common axis.

* * * * *